US005884993A

United States Patent [19]

Conn

[11] Patent Number: 5,884,993

[45] Date of Patent: Mar. 23, 1999

[54] REFLECTOR SYSTEMS FOR LIGHTING FIXTURES

[76] Inventor: Mitchell Conn, 20 The Pines, Westbury, N.Y. 11568

[21] Appl. No.: 631,236

[22] Filed: Apr. 12, 1996

[51] Int. Cl.[6] ..... F21S 3/00

[52] U.S. Cl. ..... 362/217; 362/260; 362/296; 362/347

[58] Field of Search ..... 362/216, 217, 362/247, 255, 260, 297, 346, 347, 296

[56] References Cited

U.S. PATENT DOCUMENTS 3,712,980 1/1973 Norton ..... 362/260

4,833,571 5/1989 Granovksy ..... 362/16

5,199,782 4/1993 Johnson et al. ..... 362/147

5,394,314 2/1995 Evanisko ..... 362/216

*Primary Examiner*—Stephen Husar

*Attorney, Agent, or Firm*—Bauer & Schaffer, LLP

[57] ABSTRACT

A reflector system for lighting fixtures having a frame in which one or more bulbs and a reflector is mounted. The reflector is formed of at least one sheet of PVC. Preferably, the PVC is a single integral member curved to focus the reflected light.

5 Claims, 2 Drawing Sheets

REFLECTOR SYSTEMS FOR LIGHTING FIXTURES

BACKGROUND OF THE INVENTION

The present invention relates to an improved reflector system for the construction of lighting fixtures and, in particular, to relatively long reflector systems for fluorescent lighting fixtures such as for wall, ceiling, recessed and hanging lights in industrial, commercial, and institutional installations.

In general, ceiling lights, hanging fixtures and other relatively long fluorescent fixtures are modular in construction comprising a box-like housing of rectangular shape so as to accommodate a plurality of fluorescent bulbs. The housing not only supports the bulbs at each of its ends but also provides a reflective back, directing the light outwardly of the housing. Such fixtures are most often constructed of metal and include a metallic reflector which is either painted with a high gloss finish or polished and buffed to a high gloss finish.

Very frequently, the reflector is shaped to provide a surface which is arcuate, oval, or conical so as to focus or concentrate the reflected light. It is thus needed to shape and simultaneously polish the compound curvature, which makes the reflector expensive as each must be fabricated at the factory and stored en masse until needed. They must then be transported to the site of use. A further problem arises during installation of the lighting fixture as the fixtures must often be custom fit to the allotted ceiling space.

It is the custom in this art to provide modular sized reflectors, which are generally metal, in four-foot lengths so that they can be easily stored and transported to the work site. This presents a particular problem when the fixture installation exceeds the four-foot module. In such cases, two or more reflectors must be abutted one against the other, as a result of which a seam must be formed to hold the sheets together. Because it is difficult to square the edge of curved metallic sheets, the edges do not abut perfectly and the seam is ragged. Consequently, the reflector system is itself not perfect.

It is the object of this invention to provide an improved reflector or system which overcomes the aforementioned problems and which provides an inexpensive, easy-to-install reflector for lighting fixtures.

BRIEF DESCRIPTION OF THE DRAWINGS

The present invention is described in the following description of the preferred embodiment and is illustrated in the accompanying drawings where.

DESCRIPTION OF THE PREFERRED EMBODIMENT

Figure 1:
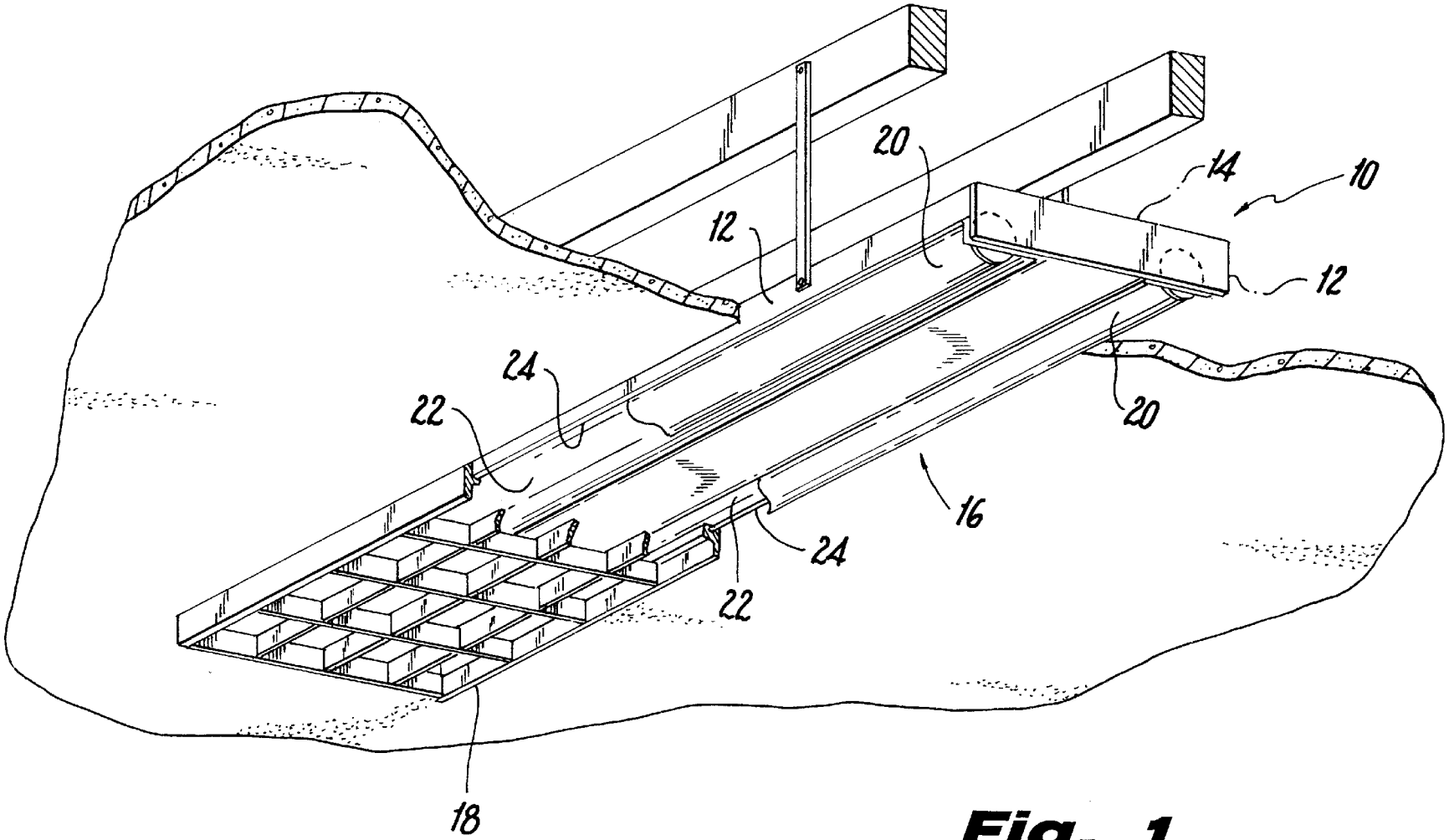
FIG. 1 is a perspective view of a lighting fixture illustrating the present invention.

The present invention is illustrated in FIG. 1 as being applied to a simple, rectilinear light fixture generally depicted by the numeral 10 comprising a frame of desired length and width formed of opposed side walls 12, top wall 14, and an open bottom wall 16. Although not critical, the bottom wall may be provided with a conventional baffle, illustrated here, but not limited to the baffle known in the art as an egg crate baffle 18 through which the light passes. Bulbs 20 such as fluorescents are mounted on the frame along with the conventional fixtures, ballasts and the like. The fixture is adapted to be ceiling hung, utilizing side straps for attachment to the ceiling beams.

In accordance with the present invention, a reflector comprising a sheet 22 of rigid, high safety, low toxicity and nonreactive polyvinylchloride (PVC) is installed within the frame between the bulbs and the top wall. In the embodiment of FIG. 1 the reflector sheet 22 abuts against the top wall 14. In an enlarged size, such sheet is inherently flexible so that it curves in the transverse direction to assume the shape of the inner surface of the top wall 14. To enable such mounting the side walls of the frame 10 are formed with opposing grooves 24 at the corner edge with the top wall 14, allowing a sheet of PVC of slightly greater width than the frame so that it can be snapped and held in place within the frame. The PVC sheet is flexible and easily cut into shape.

Several PVC sheets having the aforementioned characteristics are currently available. Such a sheet, however, must meet certain standards. It should have a boiling point in excess of 760 mm HG and a negligible volatility. Above all, it is to have an extremely high flash and flame limit, making it fire resistant. The rigid PVC sheet is self extinguish and requires no hazardous combustion protective procedure. Overexposure to heat rigid PVC sheet produces little, if any, acute or chronic effect, either to skin or eyes, nor does it have internal effect. The PVC sheet must also be stable and long-lasting even under continuous use.

The rigid PVC sheet may come in colors or be clear. Nevertheless, when backed with non transparent or translucent support, the material becomes highly reflective due to its high density and uniformly of molecular structure, forming in combination with its support a smooth almost perfect mirror by which light is reflected.

Figure 2:
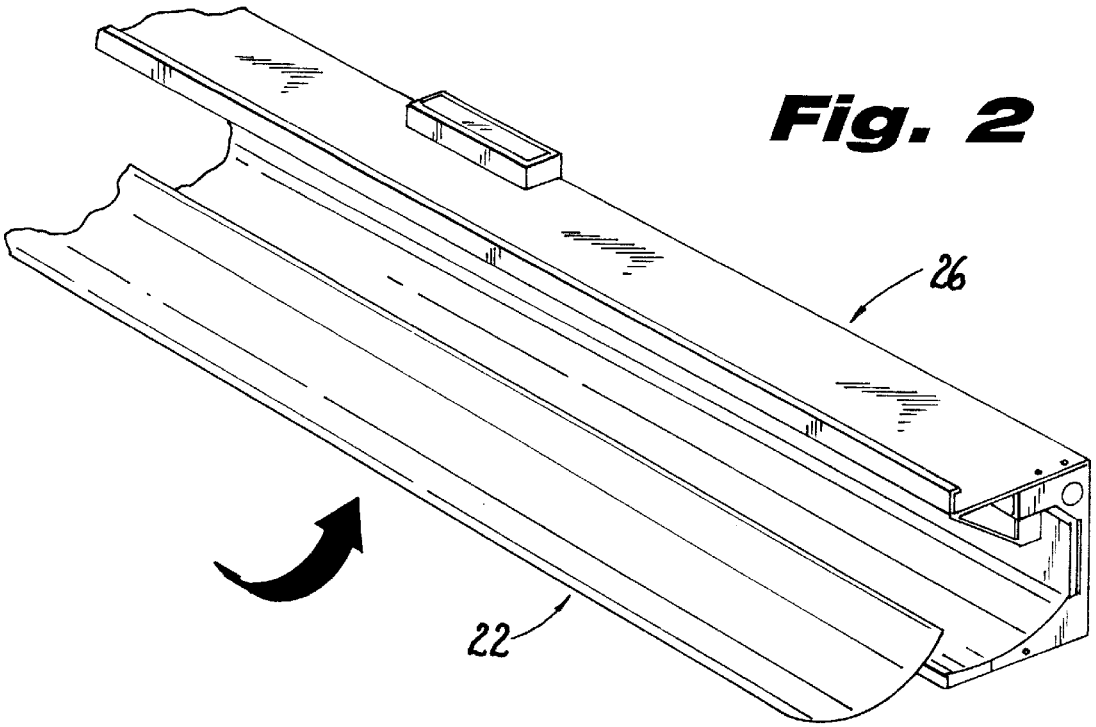
FIG. 2 is a perspective view of another lighting fixture to which the present invention may be applied.
Figure 3:
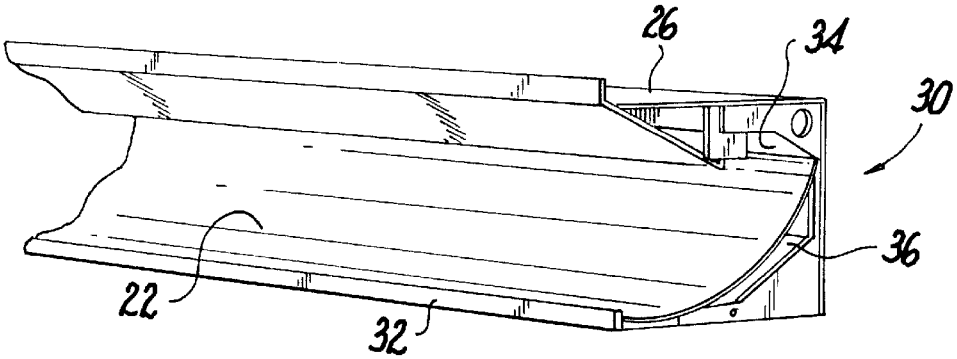
FIG. 3 is a view of the fixture seen in FIG. 2 with the reflector of the present invention installed.

An abutting back, i.e. a support wall, flush with the surface of the reflector sheet wall is not necessary as may be seen from the embodiment shown in FIG. 2. In this figure, the front or facial wall and the bulbs are removed so that the installation of the reflector will be easily seen. As seen in FIG. 2, the fixture frame 26 is an elongated channel member folded in complex fashion along the transverse plane so as to be adapted to be hung on a building wall rather than ceiling. The rigid PVC reflector 22 straddles on side wall and back wall corner 30 of the fixture so that it is held along one edge by a lip 32 on the side wall and groove 34 between the other side wall and the back wall. Thus, a space 36 is defined behind the PVC reflector and the corner 30. Nevertheless, space 36 does not allow the escape of light and thereby forms a black backing behind the reflector to allow perfect focused reflection. The PVC reflector is flexible so as bend into the shape of the fixture. It may also be easily cut into shape to assume the finished position shown in FIG. 3.

Figure 4:
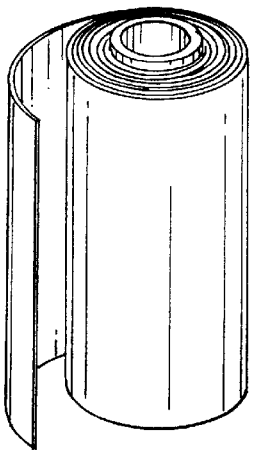
FIG. 4 is a perspective view of the reflector material prior to fabrication.

As seen in FIG. 4 the PVC sheet is manufactured and shipped in endless rolls. This makes for inventory simplicity to store and transport to the work site, where a large number of shapes and sizes can be made. The PVC is easily cut and shaped at the work site. Various shapes may be formed at the work site, for example conical reflectors and cylindrical reflectors as well as simple curves can be easily fabricated.

Among the PVC sheet material found desirable for the present invention are those manufactured by Kings Specialty Company, Brooklyn, N.Y., under any one of the trade names, PENTAPHARM, PENTAFOOD, PENTAMED and PENTA. Other suppliers are well known to those skilled in this art.

What is claimed is:

1. In combination with elongated fluorescent fixtures of the type having a frame comprising a partially open bottom wall, first and second opposed side walls, a top wall and mounting means for receiving and fixedly holding a reflector in a flexed arcuate shape, a seamless reflector comprising a continuous strip of flexible PVC material, said continuous strip of flexible PVC material having a width greater than the distance between said opposed side walls and being bendable in the transverse direction, said continuous strip of flexible PVC material being mounted in said fixture along its entire length in a fixed and curved manner.

2. The combination according to claim 1, wherein said bottom wall comprises a first section extending from said first side wall and a second section extending from said second side wall.

3. The combination according to claim 2, wherein said means for receiving said reflector comprises a first groove running latitudinally along the length of said first section and a second groove running latitudinally along the length of said second section.

4. The combination according to claim 1, wherein said continuous strip of PVC material is rolled to form a compact cylinder for easy transport.

5. The combination according to claim 1, wherein said strip is opaque.

* * * * *